US008744088B2

(12) United States Patent
Ko et al.

(10) Patent No.: US 8,744,088 B2
(45) Date of Patent: Jun. 3, 2014

(54) METHOD, MEDIUM, AND APPARATUS DECODING AN INPUT SIGNAL INCLUDING COMPRESSED MULTI-CHANNEL SIGNALS AS A MONO OR STEREO SIGNAL INTO 2-CHANNEL BINAURAL SIGNALS

(75) Inventors: Sangchul Ko, Yongin-si (KR); Youngtae Kim, Yongin-si (KR); Sangwook Kim, Yongin-si (KR); Jungho Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1367 days.

(21) Appl. No.: 11/708,001

(22) Filed: Feb. 20, 2007

(65) Prior Publication Data

US 2008/0033729 A1 Feb. 7, 2008

(30) Foreign Application Priority Data

Aug. 3, 2006 (KR) ..... 10-2006-0073470

(51) Int. Cl.
*H04R 5/00* (2006.01)

(52) U.S. Cl.
USPC ..... 381/22; 381/11; 381/17; 381/23; 704/500

(58) Field of Classification Search
USPC ..... 381/1–23, 300–311, 98–109; 700/94; 704/500, E19.001–E19.005, E19.018
See application file for complete search history.

(56) References Cited

U.S. PATENT DOCUMENTS

| | | | | |
|---|---|---|---|---|
| 6,470,087 | B1 | 10/2002 | Heo et al. | |
| 2003/0236583 | A1 | 12/2003 | Baumgarte et al. | |
| 2004/0247135 | A1 | 12/2004 | Dressler et al. | |
| 2005/0047619 | A1 * | 3/2005 | Murata et al. | 381/309 |
| 2005/0238176 | A1 | 10/2005 | Nakano | |
| 2005/0281408 | A1 | 12/2005 | Kim et al. | |
| 2006/0004583 | A1 * | 1/2006 | Herre et al. | 704/500 |
| 2006/0013405 | A1 | 1/2006 | Oh et al. | |
| 2008/0025519 | A1 * | 1/2008 | Yu et al. | 381/17 |

FOREIGN PATENT DOCUMENTS

| | | |
|---|---|---|
| KR | 10-0206333 | 4/1999 |
| KR | 10-2001-0086976 | 9/2001 |
| KR | 10-2002-0018730 | 3/2002 |
| KR | 10-2004-0035887 | 4/2004 |
| KR | 10-2006-0047444 | 5/2005 |
| KR | 10-2006-0043701 | 5/2006 |
| WO | WO 02/063925 | 8/2002 |

OTHER PUBLICATIONS

Korean Notice of Allowance issued on Aug. 29, 2007, corresponds to Korean Patent Application No. 10-2006-0073470.

* cited by examiner

*Primary Examiner* — Xu Mei
(74) *Attorney, Agent, or Firm* — Staas & Halsey LLP

(57) ABSTRACT

A decoding method, medium, and device decoding an input signal, including compressed multi-channel signals as a mono or stereo signal, into 2-channel binaural signals. A full band channel level of each channel in the multi-channel system is calculated from channel level differences between the channels, and data of each channel included in the input signal is localized in directions corresponding to the channels based on the calculated full band channel levels of the channels. Accordingly, the input signal can be output as the 2-channel binaural signals by using simple operations without having to reconstruct multi-channel signals from the input signal in a quadrature mirror filter (QMF) domain.

20 Claims, 6 Drawing Sheets

METHOD, MEDIUM, AND APPARATUS DECODING AN INPUT SIGNAL INCLUDING COMPRESSED MULTI-CHANNEL SIGNALS AS A MONO OR STEREO SIGNAL INTO 2-CHANNEL BINAURAL SIGNALS

CROSS-REFERENCE TO RELATED APPLICATIONS

This application claims the benefit of Korean Patent Application No. 10-2006-0073470, filed on Aug. 3, 2006, in the Korean Intellectual Property Office, the disclosure of which is incorporated herein in its entirety by reference.

BACKGROUND OF THE INVENTION

1. Field of the Invention

One or more embodiments of the present invention relate to audio decoding, and more particularly, to moving picture experts group (MPEG) surround audio decoding capable of down-mixing multi-channel signals to 2-channel binaural signals based on channel level differences (CLDs) and head related transfer functions (HRTFs) applied to the multi-channel signals.

2. Description of the Related Art

In conventional signal processing techniques for outputting multi-channel signals as binaural sounds, an operation of reconstructing multi-channel signals from an input signal obtained by compressing multi-channel signals into the mono or stereo signal by using spatial cues is performed. Separately, an operation of down-mixing the reconstructed multi-channel signals to 2-channel signals by binaural processing using head related transfer functions (HRTFs) is thereafter performed. As will be explained in greater detail below, such HRTFs model a sonic process of transferring a sound source localized in free space to a person's ears, and include important information for detecting the position of the sound source from the perspective of the person. Here, such separate operations of reconstructing the multi-channel signals and the down-mixing of the reconstructed multi-channel signals using head related transfer functions are complex, and it becomes difficult to generate signals in a device having limited hardware resources, such as mobile audio devices.

FIG. 1 illustrates a conventional overall system of an encoder, transmission/storage, and decoder outputting input decompressed multi-channel signals as 2-channel binaural signals.

Referring to FIG. 1, in order to output multi-channel signals as 2-channel binaural signals, the overall system includes a multi-channel encoder 102, a multi-channel decoder 104, and a binaural processing device 106.

Initially, the multi-channel encoder 102 compresses the input multi-channel signals into a mono or stereo signal, which may be considered a 'down-mixing' of the multi-channel signals. The multi-channel decoder 104 then receives such a mono or stereo input signal. The multi-channel decoder 104 then reconstructs multi-channel signals from the input signal in a quadrature mirror filter (QMF) domain by using spatial cues and transforms the reconstructed multi-channel signals into time-domain signals, which may be considered an 'up-mixing' of the received mono or stereo signal. The spatial cues may include correlations/differences between channels, e.g., correlations/differences between left and right channels such that a minimal amount of data for both channels can be sent as a single signal along with the spatial cues. Such spatial cues may also be sent/input with the input signal and can equally be used for multi-channel arrangements. In another way to minimize data, the QMF domain represents the domain wherein the input time-domain signal has been divided into multiple signals within different respective frequency bands. The different frequency bands permit compression/decompression of audio information to remove audio information within each frequency band that would not be audible or heard by a person due to that audio information being weaker than a stronger audio information in the same frequency band.

Referring back to FIG. 1, the binaural processing device 106 thereafter transforms the time-domain multi-channel signals into frequency-domain multi-channel signals and down-mixes the transformed multi-channel signals to the 2-channel binaural signals using the aforementioned head related transfer functions (HRTFs). Thereafter, the down-mixed 2-channel binaural signals are transformed into time-domain signals, respectively. As described above, in order to output the input signal, obtained by compressing the multi-channel signals into the mono or stereo signal, as the 2-channel binaural signals, both the operation of reconstructing the multi-channel signals from the input signal in the multi-channel decoder 104 and the operation of down-mixing the reconstructed multi-channels to the 2-channel binaural signals are required.

As described above, in this conventional case, there are problems in that, firstly, two processing operations are required. Therefore, decoding complexity increases. Secondly, in order to reconstruct the multi-channel signals from the input signal obtained by compressing the multi-channel signals into the mono or stereo signal, the operation performed in the QMF domain has to be performed for each channel. Therefore, many operations are required. Lastly, in order to thereafter down-mix the reconstructed multi-channel signals to the 2-channel binaural signals, through the binaural processing, a dedicated binaural processing processor is typically required.

SUMMARY OF THE INVENTION

An embodiment of the present invention provides a decoding method, medium, and device for decoding multi-channel signals into 2-channel binaural signals, by synthesizing an input signal, obtained by compressing the multi-channel signals into a mono or stereo signal, as the 2-channel binaural signals without having to reconstruct multi-channel signals from the input signal in the quadrature mirror filter (QMF) domain.

Additional aspects and/or advantages of the invention will be set forth in part in the description which follows and, in part, will be apparent from the description, or may be learned by practice of the invention.

According to an aspect of the present invention, one or more embodiments of the present invention include a method of decoding an input signal including compressed multi-channel signals as a mono or stereo signal, the method including calculating a full band channel level (FBCL) for each channel represented in the input signal from channel level differences (CLDs) between the represented channels, localizing data of each represented channel in directions corresponding to respective represented channels based on calculated FBCLs for select channels, other than all of the channels represented in the input signal, to be output, and outputting the localized data for the select channels.

According to an aspect of the present invention, one or more embodiments of the present invention include a method of decoding an input signal including compressed multi-channel signals as a mono or stereo signal, the method including calculating a sub-band channel level (SBCL) for each channel represented in the input signal from channel level differences (CLDs) between the represented channels, localizing data of each represented channel in directions corresponding to the represented channels based on calculated SBCLs for select channels, other than all of the channels represented in the input signal, to be output, and outputting the localized data for the select channels.

According to an aspect of the present invention, one or more embodiments of the present invention include at least one medium including computer readable code to control at least one processing element to implement embodiments of the present invention.

According to an aspect of the present invention, one or more embodiments of the present invention include a decoding device to decode an input signal including compressed multi-channel signals as a mono or stereo signal, the device including a channel level analyzer to calculate a full band channel level (FBCL) for each channel represented in the input signal from channel level differences (CLDs) between the represented channels, and a 2-channel synthesizer to localize data of each represented channel in directions corresponding to the represented channels based on calculated FBCLs for select channels, other than all of the channels represented in the input signal, to be output, and to output the localized data for the select channels.

According to an aspect of the present invention, one or more embodiments of the present invention include a decoding device for decoding an input signal including compressed multi-channel signals as a mono or stereo signal, the device including a channel level analyzer to calculate a sub-band channel level (SBCL) for each channel represented in the input signal from channel level differences (CLDs) between the represented channels, and a 2-channel synthesizer to localize data of each represented channel in directions corresponding to the represented channels based on calculated SBCLs of select channels, other than all of the channels represented in the input signal, to be output, and to output the localized data for the select channels.

According to an aspect of the present invention, one or more embodiments of the present invention include a method of decoding an input signal including compressed multi-channel signals with spatial cues, the method including generating equalized sub-band levels for each channel from channel level differences (CLDs) information from the spatial cues, applying the generated equalized sub-band levels to respective head related transfer functions to generate weighted head related transfer functions, localizing data of each respective channel in corresponding directions by applying, in a frequency domain, weighted head related transfer functions of select channels to the input signal converted into the frequency domain, and outputting time-domain audio signal channels from the frequency domain localized data for the select channels.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
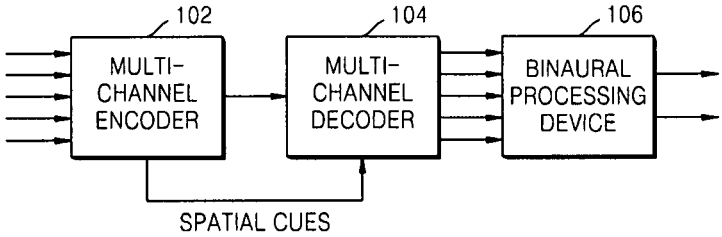
FIG. 1 (PRIOR ART)
FIG. 1 illustrates a conventional overall system outputting decoded multi-channel signals as 2-channel binaural signals.

Reference will now be made in detail to embodiments of the present invention, examples of which are illustrated in the accompanying drawings, wherein like reference numerals refer to the like elements throughout. Embodiments are described below to explain the present invention by referring to the figures.

Figure 2:
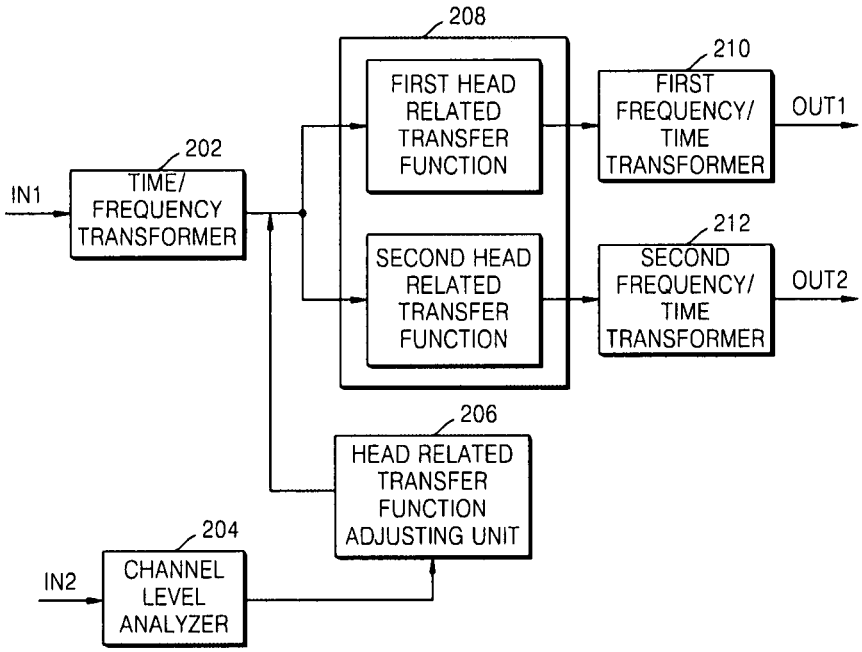
FIG. 2 illustrates a decoding device for decoding multi-channel signals into 2-channel binaural signals, according to an embodiment of the present invention.

FIG. 2 illustrates a decoding device for decoding multi-channel signals into 2-channel binaural signals, according to an embodiment of the present invention.

As shown in FIG. 2, the decoding device may include a time/frequency transformer 202, a channel level analyzer 204, a head related transfer function (HRTF) adjusting unit 206, a 2-channel synthesizer 208, a first frequency/time transformer 210, and a second frequency/time transformer 212, for example.

The time/frequency transformer 202 may receive an input signal obtained by compressing multi-channel signals into a mono or a stereo signal through an input terminal IN 1, for example, and transform the input signal into a frequency-domain signal.

The channel level analyzer 204 analyzes information on channel level differences (CLDs), e.g., input through an input terminal IN 2, in order to obtain a full band channel level (FBCL) for each channel in the multi-channel system. Here, the FBCL is a representative energy level from among energy levels of bands within each channel in the multi-channel system and can have a constant energy level across the full band, respectively.

Figure 3A:
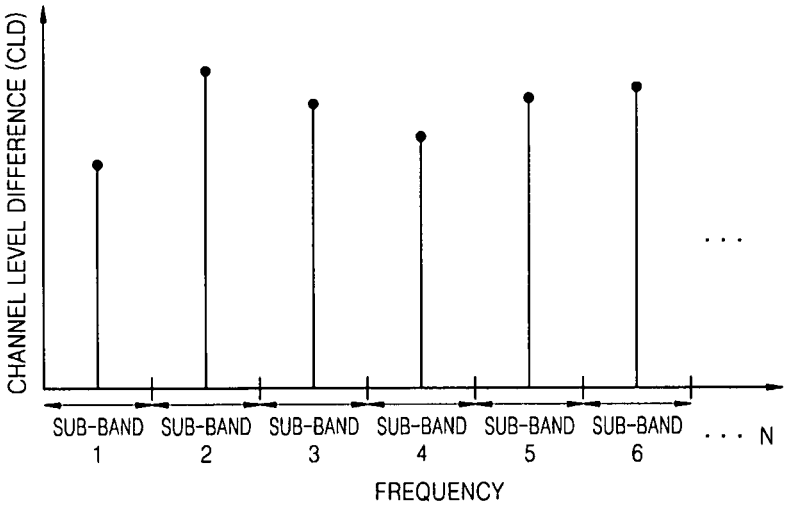
FIG. 3A illustrates channel level differences (CLDs) between channels in a multi-channel system, in the frequency domain.

FIG. 3A illustrates an example of channel level differences (CLDs) between channels that form the multi-channel system in the frequency domain.

Referring to FIG. 3A, when the CLDs between the channels in the multi-channel system are transformed into the frequency domain, the CLDs have different values from each other according to bands. In general, the CLDs are used to reconstruct multi-channel signals in the quadrature mirror filter (QMF) domain. However, in an embodiment of the present invention, the CLDs may be used in the frequency domain, outside of the conventionally required QMF domain. Therefore, the CLDs have to be transformed into the frequency domain in order to be used.

Figure 3B:
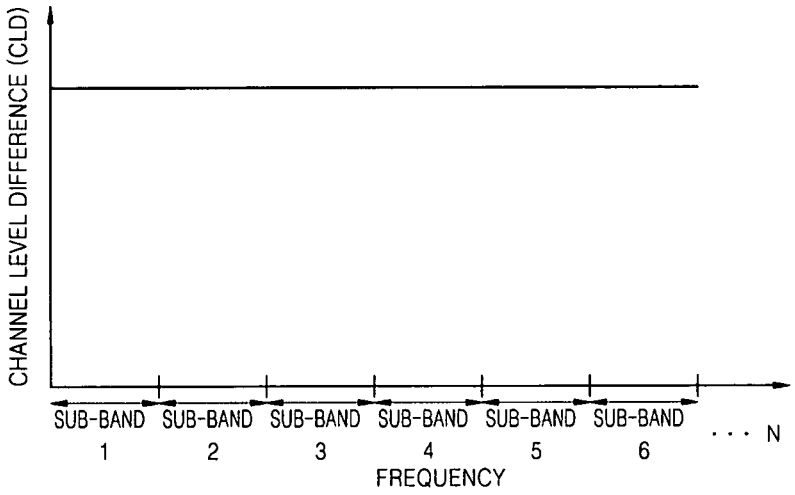
FIG. 3B illustrates CLDs between channels in a multi-channel system, where the CLDs are adjusted so as to have a constant energy value across the full band in the frequency domain, according to an embodiment of the present invention.

FIG. 3B illustrates CLDs between channels in the multi-channel system, where the CLDs have been adjusted so as to have a constant energy value across the full band, in the frequency domain, according to an embodiment of the present invention.

Here, according to an embodiment of the present invention, CLDs having different values according to sub-bands of each channel in the multi-channel system in the frequency domain may be adjusted to a representative energy level across the full band, i.e., all bands. The channel level analyzer 204 filters the different CLDs according to bands in the frequency domain in order to obtain a constant energy level across the full band of each channel through a predetermined calculation as shown in FIG. 3B. The representative energy level across the full band of each channel is denoted by the full band channel level (FBCL). The channel level analyzer 204 may use the below Equation 1, for example, to obtain the FBCL, noting that embodiments are not limited thereto.

$$FBCL(i)=K(i,j)\cdot A(j) \quad \text{Equation 1:}$$

Here, A denotes a weighted value for a band, K denotes a channel level difference, i denotes a channel number, and j denotes a band number.

As shown in Equation 1, the FBCL can be calculated by multiplying a channel level difference by a weighted band level in the frequency domain.

The FBCL, e.g., calculated in the channel level analyzer 204, may be set as the gain value of the HRTF in the HRTF adjusting unit 206. More specifically, in order to set the FBCL as the gain value of the HRTF, the HRTF can be multiplied by the FBCL in order to adjust the HRTF. In this case, since the FBCLs have different values depending on the channel, the HRTFs are also adjusted to have different values according to the respective channels. As noted above, the HRTFs may model a sonic process of transferring a sound source localized in free space to a person's ears, and include important information for detecting the position of the sound source from the perspective of the person, including information representing the perceived direction of the received sound. The HRTFs may take into account inter-aural time differences, inter-aural level differences, and a shape of an auricle, for example, and may include a lot of information about the properties of a space in which the sound is transferred.

The 2-channel synthesizer 208 may localize data of each channel included in the input signal, transformed into the frequency-domain signal by the time/frequency transformer 202, in directions corresponding to respective channels by using a first HRTF in which a gain value has been set and a second HRTF in which a gain value has been set. More specifically, according to an embodiment of the present invention, in order to localize the data of each channel included in the input signal in directions corresponding to the channel based on the FBCLs of the channels calculated in the channel level analyzer 204, the HRTFs are used.

As noted above, the FBCLs typically have different values depending on the respective channels. Therefore, the 2-channel synthesizer 208 may use HRTFs that have been adjusted to have different gain values for each respective channel. Therefore, when the data of each channel included in the input signal is localized in directions corresponding to each respective channel, the localized data of each channel can be output in proportion to the defined gain values, so that the data of the channels are listened to separately. However, since a constant gain value is used across the full band, such a separation effect according to bands may not be good.

The first frequency/time transformer 210 may receive a left signal from among signals output from the 2-channel synthesizer 208, e.g., from the first head related transfer function, so it can transform the left signal into a time-domain signal, e.g., to be output through an output terminal OUT 1.

The second frequency/time transformer 212 may receive a right signal from among signals output from the 2-channel synthesizer 208, e.g., from the second head related transfer function, so it can transform the right signal into a time-domain signal, e.g., to be output through an output terminal OUT 2.

Figure 4:
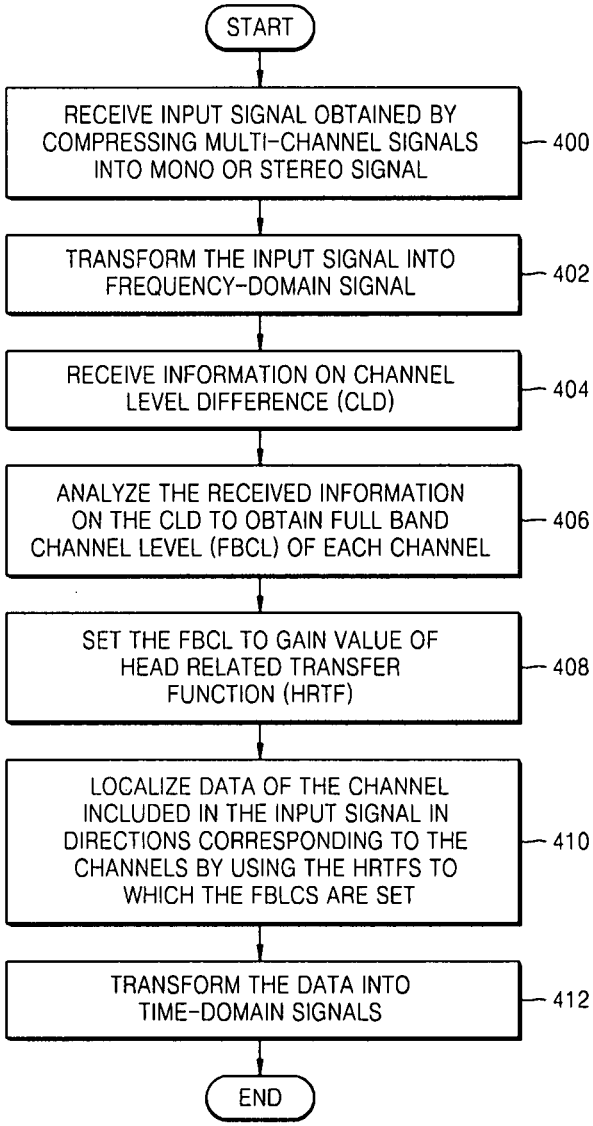
FIG. 4 illustrates a method of decoding multi-channel signals into 2-channel binaural signals, according to an embodiment of the present invention.

FIG. 4 illustrates a method of decoding multi-channel signals into 2-channel binaural signals, according to an embodiment of the present invention. As noted below, such operations may be performed with reference to the decoding device as shown in FIG. 2, but embodiments of the present invention are not limited thereto.

An input signal, obtained by compressing multi-channel signals into a mono or stereo signal, may be received, e.g., by the time/frequency transformer 202 through an input terminal IN 1, in operation 400.

The input signal may then be transformed into a frequency-domain signal, e.g., by the time/frequency transformer 202, in operation 402.

Information on channel level differences (CLDs) may further be received, e.g., by the channel level analyzer 204, from among spatial cues that are generated when the multi-channel signals were initially compressed into the mono or stereo signal and can be used to reconstruct the input signal.

The received CLDs may then be analyzed, e.g., by the channel level analyzer 204, in order to obtain an FBCL for each channel.

In one embodiment, the aforementioned Equation 1 may be used to obtain the FBCL.

In a further embodiment, the obtained FBCL has a constant energy level across the full band as shown in FIG. 3B, for example.

The obtained FBCL may be set to a gain value of a HRTF, e.g., by the HRTF adjusting unit 206, in operation 408. In this case, since only the gain value is adjusted in a measured HRTF, only the output magnitude of the HRTF changes and the HRTF itself is not modified.

The FBCLs obtained in the channel level analyzer 204 have different values depending on the respective channels, so that a signal output from a channel having a greater gain value is louder than other signals. More specifically, data of the channels included in the input signal are localized in directions corresponding to the respective channels based on the FBCLs that are set to the gain values. Here, in effect, the FBCLs serves as a filter.

The HRTFs having different gain values depending on the respective channels may be used, e.g., by the 2-channel synthesizer 208, to localize the data of each channel in directions corresponding to the channel, to be synthesized as 2-channel signals. In this case, the synthesized signals are divided into a left signal component and a right signal component.

Thus, the left and right signal components, e.g., output from the 2-channel synthesizer 208, may be transformed into time-domain signals, e.g., by the first and second frequency/time transformers 210 and 212 to be output through the example output terminals OUT 1 and OUT 2, respectively, in operation 412.

Figure 5:
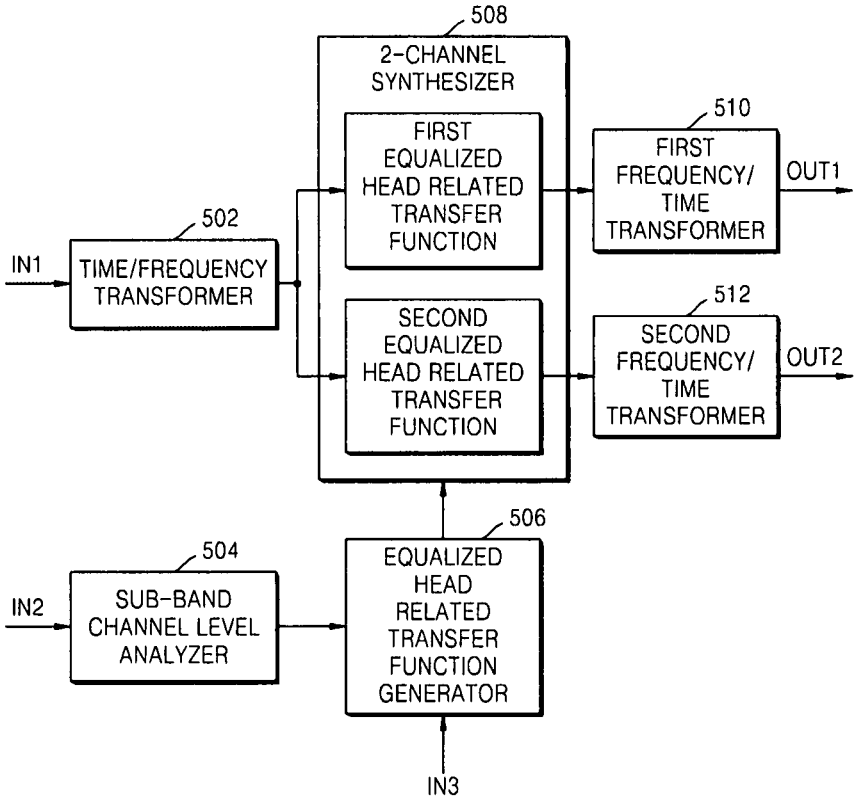
FIG. 5 illustrates a decoding device for decoding multi-channel signals into 2-channel binaural signals, according to another embodiment of the present invention.

FIG. 5 illustrates a decoding device for decoding multi-channel signals into 2-channel binaural signals, according to another embodiment of the present invention.

Here, the decoding device may include a time/frequency transformer 502, a sub-band channel level analyzer 504, an equalized head related transfer function (eHRTF) generator 506, a 2-channel synthesizer 508, a first frequency/time transformer 510, and a second frequency/time transformer 512, for example.

The time/frequency transformer 502 may receive an input signal, e.g., obtained by compressing multi-channel signals into a mono or stereo signal, through an example input terminal IN1 in order to transform the input signal into a frequency-domain signal.

The sub-band channel level analyzer 504 may then calculate a sub-band channel level (SBCL) for each channel in the multi-channel system by using information on channel level differences (CLDs) input through an example input terminal IN 2. More specifically, the sub-band channel level analyzer 504 may adjust the CLDs having different levels according to respective bands in a respective channel so as to calculate a FBCL based on the CLDs according to the sub-bands shown in FIG. 3C.

In this case, the below Equation 2 may be used to obtain the SBCLs, for example.

$$SBCL(i,k)=K(i,j)\cdot B(j,k) \quad \text{Equation 2:}$$

Here, K denotes a channel level difference (CLD) in the frequency domain, B denotes an interpolation coefficient of a respective band, i denotes a respective channel number, j denotes the respective band number, and k denotes the respective frequency number.

As shown in Equation 2, the SBCL may be calculated by multiplying a CLD by an interpolation coefficient of each band in the frequency domain, so that continuous energy levels across the full band are calculated.

The eHRTF generator 506 may synthesize the SBCL, obtained in the sub-band channel level analyzer 504, and the HRTF, input through the input terminal IN3, for example, so as to generate an eHRTF. In this embodiment, the eHRTFs represent HRTFs using CLDs between the channels according to bands in the frequency domain. The below, Equation 3 may be used as a method of generating the eHRTF, for example.

Equation 3:

$$\begin{Bmatrix} eHRTF_i(i) \\ eHRTF_c(i) \end{Bmatrix} = SBCL(i) \times \begin{Bmatrix} HRTF_i(i) \\ HRTF_c(i) \end{Bmatrix}$$

Here, SBCL denotes a sub-band channel level $HRTF_i(i)$ and $HRTF_c(i)$ denotes a pair of HRTFs in a direction of a channel, $HRTF_i(i)$ denotes a HRTF in a direction close to a direction of a sound source, $HRTF_c(i)$ denotes a HRTF in a direction far from a direction of the sound source, i denotes a channel number, and j denotes a band number.

The 2-channel synthesizer 508 may use the eHRTFs to localize data of each channel included in the input signal in directions corresponding to the respective channels. The eHRTFs uses the CLDs between the channels according to bands in the frequency domain. Therefore, when the data of each channel is localized in directions corresponding to the channels, the localized data of each channel can be generated based on energy levels of the respective channels according to the respective bands. Accordingly, the data of the respective channels can be listened to separately depending on the respective bands. Therefore, unlike the embodiment shown in FIG. 2, this embodiment has a channel separation effect according to bands similar to the channel separation effect according to bands using a conventional quadrature mirror filter (QMF) domain, without performing the channel separation in the QMF domain.

The first frequency/time transformer 510 may receive a left signal from among signals output from the 2-channel synthesizer 508, e.g., from the first equalized head related transfer function, in order to transform the left signal into a time-domain signal, e.g., that may be output through an output terminal OUT1.

The first frequency/time transformer 512 may receive a right signal from among signals output from the 2-channel synthesizer 208, e.g., from the first equalized head related transfer function, in order to transform the right signal into a time-domain signal, e.g., that may be output through an output terminal OUT2.

Figure 6:
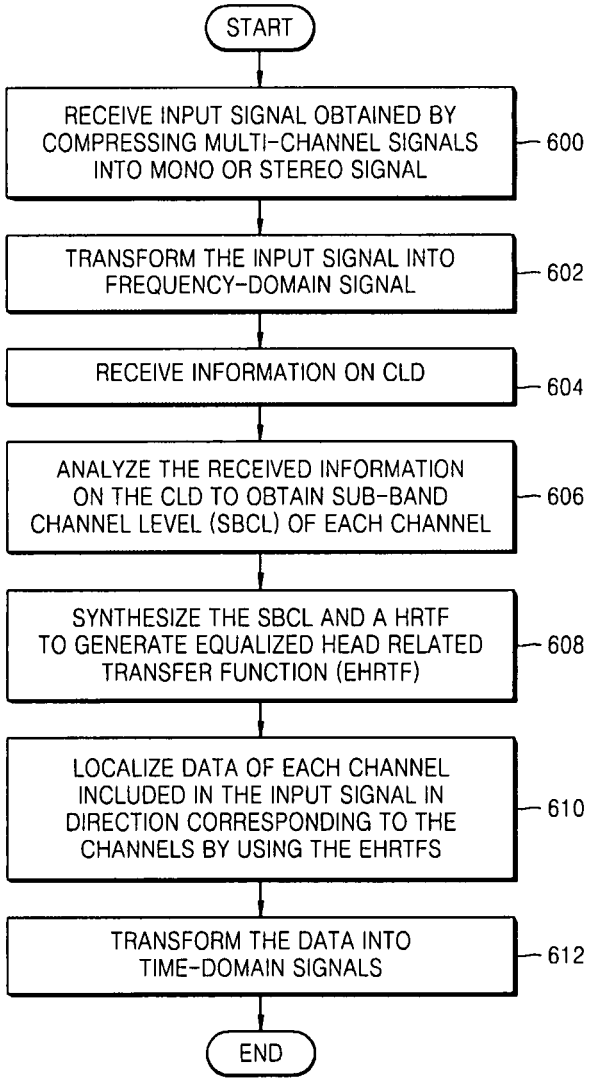
FIG. 6 illustrates a method of decoding multi-channel signals into 2-channel binaural signals, according to another embodiment of the present invention.

FIG. 6 illustrates a method of decoding multi-channel signals into 2-channel binaural signals, according to another embodiment of the present invention.

Here, an input signal, obtained by compressing multi-channel signals into a mono or stereo signal, may be received, e.g., by the time/frequency transformer 502 through an input terminal IN 1, in operation 600.

The input signal may further be transformed into a frequency-domain signal, e.g., by the time/frequency transformer 502, in operation 602.

Information on CLDs from spatial cues, which are generated when the multi-channel signals were initially compressed into the mono or stereo signal, may also be received, e.g., by the sub-band channel level analyzer 504 and input through an input terminal IN2, and used to reconstruct the signal, in operation 604.

The received CLDs may then be analyzed, e.g., by the sub-band channel level analyzer 504, to obtain a SBCL for each channel. For this, the aforementioned Equation 2 may be used to obtain the SBCLs.

Figure 3C:
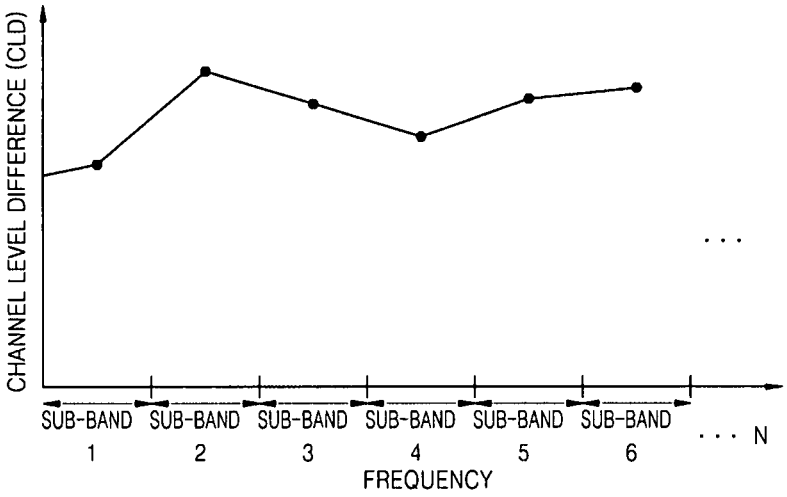
FIG. 3C illustrates CLDs between channels in a multi-channel system, where the CLDs are represented as continuous energy values across the full band in the frequency domain, according to another embodiment of the present invention.

As an example, the obtained SBCLs may be represented as continuous energy levels across the full band based on the CLDs according to the respective bands as shown in FIG. 3C.

HRTFs, e.g., input through an input terminal IN3, and the SBCLs may be synthesized, e.g., by the eHTRF generator 506, in operation 608. In this case, in another embodiment of the present invention, the aforementioned Equation 3 may be used to generate the eHRTFs using the CLDs according to the respective bands.

The eHRTFs may be used to localize the data of each channel in directions corresponding to the respective channels, e.g., by the 2-channel synthesizer 508. In this case, the synthesized signals may then be divided into a left signal component and a right signal component.

Thereafter, as en example, in operation 612, the first and second frequency/time transformers 510 and 512 may transform the left and right signal components into time-domain signals to be output through the aforementioned output terminals OUT1 and OUT2, respectively.

According to a decoding method, medium, and device outputting the multi-channel signals as 2-channel binaural signals, in one or more embodiments of the present invention, there are advantages in at least that, firstly, an operation of reconstructing an input signal, generated previously by compressing multi-channel signals into a mono or stereo signal, and a binaural processing operation of down-mixing the input signal to the 2-channel signals are performed simultaneously. Therefore, coding is simple. Secondly, the conventional operation of reconstructing the input signal in the QMF domain is not needed. Therefore, the number of operations is reduced.

Accordingly, a spatial audio signal can be reproduced by a mobile audio device having limited hardware resources without deterioration. In addition, a desktop video having greater hardware resources than the mobile audio device can also reproduce high-quality audio using a previously allocated hardware resource. Lastly, the multi-channel reconstructing operation and the binaural processing operation can also be performed simultaneously, so that an additional binaural processing dedicated processor is not required. Therefore, spatial audio can be reproduced by using a reduced amount of hardware resources.

Still further, according to an embodiment of the present invention, data of each channel included in an input signal can be localized based on input CLDs based on the respective bands, so that a loss of spatial cues can be minimized. Therefore, the data can be reproduced without sound quality degradation.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDs), and storage/transmission media such as carrier waves, as well as through the Internet, for example. Here, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of decoding an input signal comprising compressed multi-channel signals as a mono or stereo signal, the method comprising:

receiving the input signal and information on channel level differences (CLDs) between channels represented in the input signal;

calculating a full band channel level (FBCL) for each channel represented in the input signal based on the CLDs;

performing binaural synthesis by localizing data of each represented channel in directions corresponding to respective represented channels based on calculated FBCLs for the represented channels, in the input signal; and outputting synthesized 2-channel binaural signals, wherein the FBCLs are calculated by respectively multiplying a CLD by a weighted level of a band, in the frequency domain such that CLDs having different values are individually adjusted to a constant level across a full band.

2. The method of claim 1, wherein the localizing of the data of each represented channel comprises localizing the data of each represented channel based on the calculated FBCLs for the represented channels, in the frequency domain.

3. The method of claim 1, wherein the performing binaural synthesis comprises setting a respective FBCL for each represented channel as a gain value for a respective HRTF (head related transfer function) and localizing the data of each represented channel by using the respective HRTF having the set gain value.

4. The method of claim 1, further comprising transforming the input signal into a frequency-domain signal, wherein the performing binaural synthesis comprises localizing the data of each represented channel included, in a frequency domain, based on the calculated FBCLs for the represented channels and transforming respective localized data into time-domain signals.

5. At least one non-transitory medium comprising computer readable code to control at least one processing element to implement the method of claims 1.

6. The method of claim 1, wherein the CLDs having the different values are adjusted to a representative energy level across the full band.

7. The method of claim 1, further comprising performing a multi-channel reconstructing operation and a binaural processing operation simultaneously.

8. A method of decoding an input signal comprising compressed multi-channel signals as a mono or stereo signal, the method comprising:

receiving an input signal and information on channel level differences (CLDs) between channels represented in the input signal;

calculating a sub-band channel level (SBCL) for each channel represented in the input signal based on the CLDs;

performing binaural synthesis by localizing data of each represented channel in directions corresponding to the represented channels based on calculated SBCLs for the represented channels in the input signal; and outputting synthesized 2-channel binaural signals, wherein the SBCLs are calculated by respectively multiplying a CLD by an interpolation coefficient of each band to have continuous energy levels across the full band, in the frequency domain.

9. The method of claim 8, wherein the localizing of the data of each represented channel comprises localizing the data of each represented channel based on the calculated SBCLs for the represented channels, in the frequency domain.

10. The method of claim 8, wherein the performing binaural synthesis comprises synthesizing a SBCL for each represented channel and a corresponding HRTF in order to generate an equalized head related transfer function (eHRTF) using a CLD for the each represented channel and localizing the data of each represented channel by using the generated eHRTFs.

11. The method of claim 8, further comprising transforming the input signal into a frequency-domain signal, wherein the performing binaural synthesis comprises localizing the data of each represented channel, in a frequency domain, based on the calculated SBCLs for the represented channels and transforming respective localized data into time-domain signals.

12. At least one non-transitory medium comprising computer readable code to control at least one processing element to implement the method of claim 8.

13. A decoding device to decode an input signal comprising compressed multi-channel signals as a mono or stereo signal, the device comprising:

a channel level analyzer to receive information on channel level differences (CLDs) between channels represented in the input signal and to calculate a full band channel level (FBCL) for each channel represented in the input signal based on the CLDs; and a 2-channel synthesizer to perform binaural synthesis by localizing data of each represented channel in directions corresponding to the represented channels based on calculated FBCLs for the represented channels, and to output synthesized 2-channel binaural signals, wherein the FBCLs are calculated by respectively multiplying a CLD by a weighted level of a band, in the frequency domain such that CLDs having different values are individually adjusted to a constant level across a full band.

14. The device of claim 13, wherein the 2-channel synthesizer localizes the data of each represented channel based on the calculated FBCLs for the represented channels, in the frequency domain.

15. The device of claim 13, further comprising a HRTF adjusting unit to set a respective FBCL for each represented channel as a gain value of a respective HRTF, wherein the 2-channel synthesizer performs binaural synthesis by using the respective HRTF having the set gain value.

16. A decoding device for decoding an input signal comprising compressed multi-channel signals as a mono or stereo signal, the device comprising:

a channel level analyzer to receive information on channel level differences (CLDs) between channels represented in the input signal and to calculate a sub-band channel level (SBCL) for each channel represented in the input signal based on the CLDs; and a 2-channel synthesizer to perform binaural synthesis by localizing data of each represented channel in directions corresponding to the represented channels based on calculated SBCLs of the represented channels, and to output synthesized 2-channel binaural signals, wherein the SBCLs are calculated by respectively multiplying a CLD by an interpolation coefficient of each band to have continuous energy levels across the full band, in the frequency domain.

17. The device of claim 16, wherein the 2-channel synthesizer localizes the data of each represented channel based on the calculated SBCLs for the represented channels, in the frequency domain.

18. The device of claim 16, further comprising an eHRTF generator to synthesize a SBCL for each represented channel and a corresponding HRTF in order to generate an eHRTF using a CLD of the select channel based on bands, wherein the 2-channel synthesizer performs binaural synthesis by using generated eHRTFs.

19. The device of claim 16, further comprising:

a time/frequency transformer to transform the input signal into a frequency-domain signal for input to the 2-channel synthesizer; and first and second frequency/time transformers to transform left and right signal components output from the 2-channel synthesizer into time-domain signals, respectively.

20. A method of decoding an input signal comprising compressed multi-channel signals, the method comprising:

receiving the input signal and spatial cues;

generating equalized sub-band levels for each channel from channel level differences (CLDs) information from the spatial cues, the equalized sub-band levels being equal for all sub-bands for each respective channel;

applying the generated equalized sub-band levels to respective head related transfer functions to generate weighted head related transfer functions;

performing binaural synthesis by localizing data of each respective channel in corresponding directions by applying, in a frequency domain, weighted head related transfer functions for represented channels to the input signal converted into the frequency domain; and outputting 2-channel binaural signals converted into time-domain from the frequency domain.

* * * * *

UNITED STATES PATENT AND TRADEMARK OFFICE

CERTIFICATE OF CORRECTION

PATENT NO. : 8,744,088 B2
APPLICATION NO. : 11/708001
DATED : June 3, 2014
INVENTOR(S) : Ko et al.

It is certified that error appears in the above-identified patent and that said Letters Patent is hereby corrected as shown below:

In the Claims

Column 10, Line 14, Claim 5, delete “claims” and insert -- claim --, therefor.

Signed and Sealed this
Thirtieth Day of September, 2014

Michelle K. Lee

Michelle K. Lee
*Deputy Director of the United States Patent and Trademark Office*